US008439716B2

(12) United States Patent
Mandrik

(10) Patent No.: US 8,439,716 B2
(45) Date of Patent: May 14, 2013

(54) MARKER FOR FLOATING ON THE SURFACE OF A BODY OF WATER

(76) Inventor: Paul Mandrik, Clinton Township, MI (US)

( * ) Notice: Subject to any disclaimer, the term of this patent is extended or adjusted under 35 U.S.C. 154(b) by 338 days.

(21) Appl. No.: 12/945,374

(22) Filed: Nov. 12, 2010

(65) Prior Publication Data

US 2011/0136399 A1 Jun. 9, 2011

Related U.S. Application Data

(60) Provisional application No. 61/260,152, filed on Nov. 11, 2009.

(51) Int. Cl.

| | |
|---|---|
| ***B63B 22/00*** | (2006.01) |
| ***B63B 22/16*** | (2006.01) |
| ***B63B 22/166*** | (2006.01) |
| ***B63B 45/00*** | (2006.01) |
| ***B63B 45/02*** | (2006.01) |
| ***B63C 7/26*** | (2006.01) |

(52) U.S. Cl.
USPC ..... 441/6; 441/13; 441/16

(58) Field of Classification Search ..... 441/1, 6–20, 441/133, 134; 43/17.5; 116/26, 107, 108, 116/202, 209–211; 136/206, 291; 362/183
See application file for complete search history.

(56) References Cited

U.S. PATENT DOCUMENTS

| | | | | | |
|---|---|---|---|---|---|
| 1,374,942 | A | * | 4/1921 | Melvin | 441/16 |
| 1,481,583 | A | * | 1/1924 | Anundi | 441/16 |
| 3,775,787 | A | | 12/1973 | Rager | |
| 4,544,364 | A | | 10/1985 | Bankstom | |
| 4,763,126 | A | * | 8/1988 | Jawetz | 340/985 |
| 4,896,620 | A | * | 1/1990 | Jones | 114/253 |
| 5,066,256 | A | * | 11/1991 | Ward, Sr. | 441/7 |
| 5,231,781 | A | | 8/1993 | Dunbar | |
| 5,350,330 | A | | 9/1994 | Platis | |

* cited by examiner

*Primary Examiner* — Ajay Vasudeva
(74) *Attorney, Agent, or Firm* — Dickinson Wright PLLC

(57) ABSTRACT

A floating marker for marking the location of a line in the water. The marker has a cylindrical shape and includes a pair of clips for attaching to a line while allowing the marker to move along the line. The marker includes a lighting module having a plurality of LEDs for illuminating the marker at during low visibility conditions, e.g. at night. The lighting module also includes a solar collector for charging a power source during the day. Finally, the lighting module includes a light sensor and controller allowing the amount of light emitted from the marker to be controlled either automatically or manually.

1 Claim, 5 Drawing Sheets

MARKER FOR FLOATING ON THE SURFACE OF A BODY OF WATER

CROSS REFERENCE TO RELATED APPLICATION

This application claims the benefit of application Ser. No. 61/260,152 filed on Nov. 11, 2009.

TECHNICAL FIELD

The invention relates generally to a marker for showing the position of a boat anchor line. More specifically, the invention relates to a marker that has a light source for visually showing the location of the anchor line when the anchor is in a body of water.

BACKGROUND OF THE INVENTION

A longstanding problem for boaters and other watercraft users is the inability to know that an anchor line is in the path of their boat or other water craft. This is particularly problematic in bad weather, the evening or after dark when visibility is very low. It is also problematic when small watercrafts, such as jet skis, are driven close to boats that are anchored. Since these small watercraft can closely approach a boat, there is a greater potential for these watercraft to hit the anchor line. Skiers are also at risk for injury when they ski in the general proximity of anchored boats.

The problem exists because anchor lines are small in diameter and extend outwardly from the boat. They also often have a color that has a tendency to blend in with the surroundings. In other words, especially in low visibility conditions, it is often difficult to see anchor lines.

SUMMARY OF THE INVENTION

The present invention provides a solution to the problem of not being able to see an anchor line attached to a boat. Specifically, the present invention provides for a visible marker that attaches to an anchor line and increases the visibility of the anchor line. The disclosed marker has a diameter that is greater than the diameter of the anchor line and a length that is selected to make the unit visible, even in low visibility conditions, to operators of watercrafts, skies, etc. To enhance the visibility of the marker during the daylight, the marker has a color that is easily distinguishable from the water. To enhance the visibility of the marker at night, the marker is formed of a translucent material and a lighting module is mounted within the marker to illuminate the marker. A power source, such as a battery, is housed within the marker, and a solar collector is housed on the outer surface of the marker to charge the power source during the day.

In the enabling embodiment, the marker includes a pair of clips for attaching to the anchor line while allowing the marker to move along the line, ensuring that the marker will float at or extend above the water line. In addition, the marker includes a light sensor and a controller for allowing the amount of light emitted from the marker to be controlled both or manually.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENT

Figure 1:
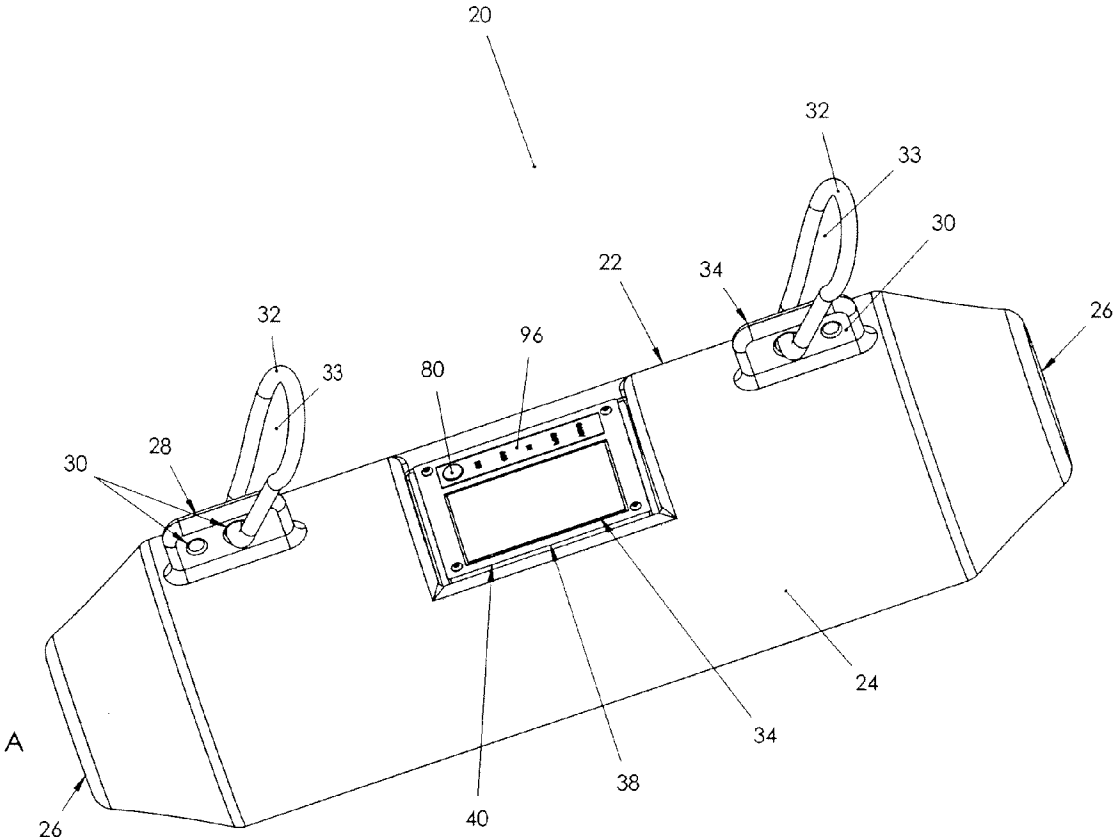
FIG. 1 is a perspective view of the marker of the present invention.
Figure 1:
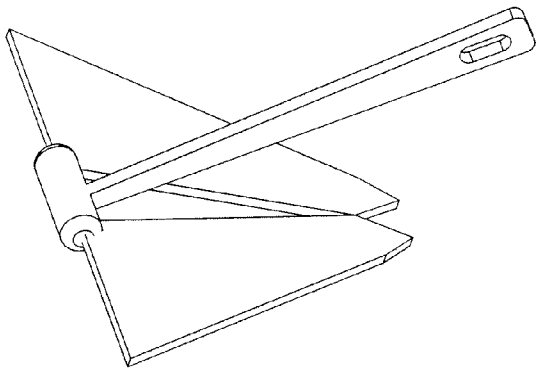
Figure 2:
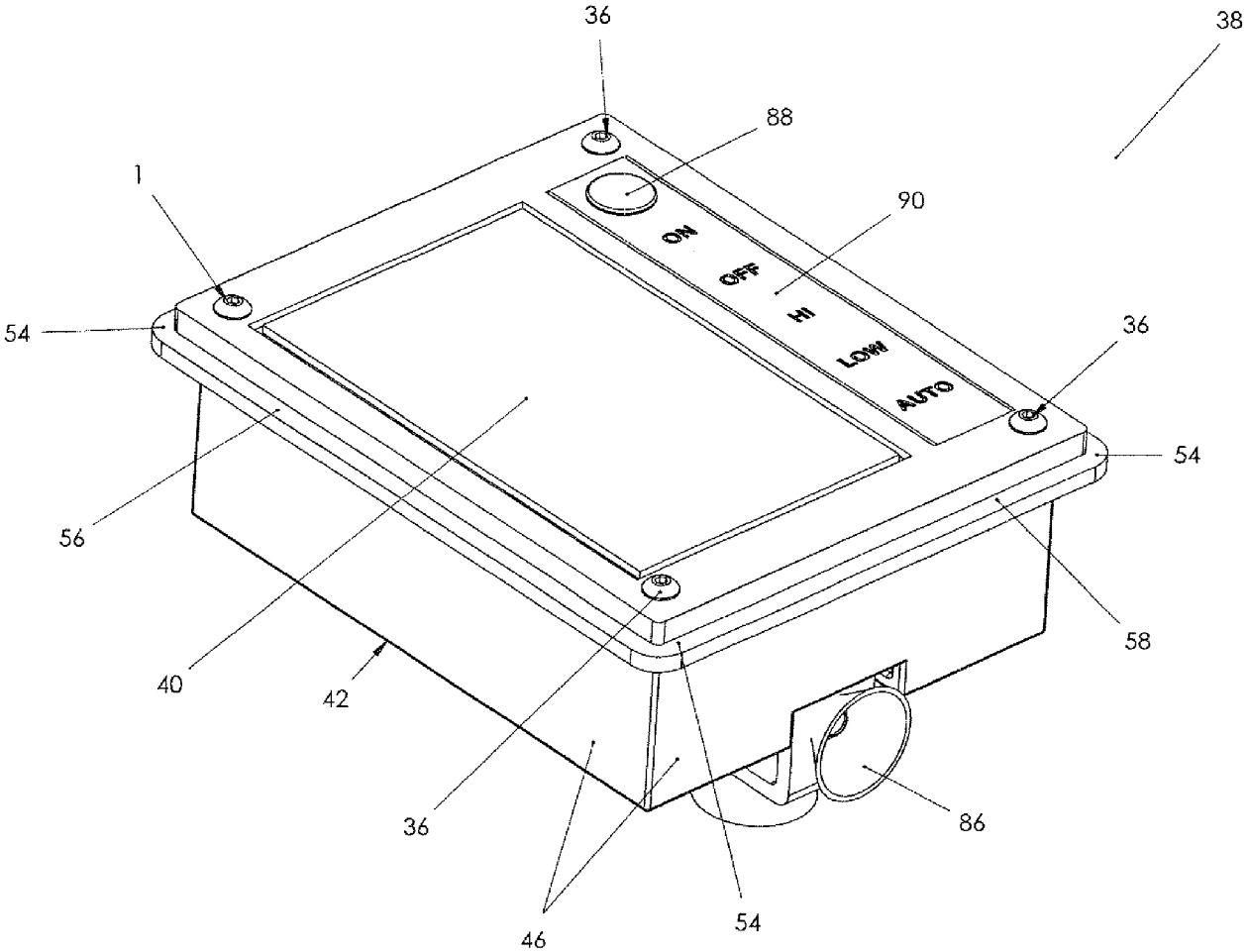
FIG. 2 is a perspective view of the lighting module of the present invention.
Figure 3:
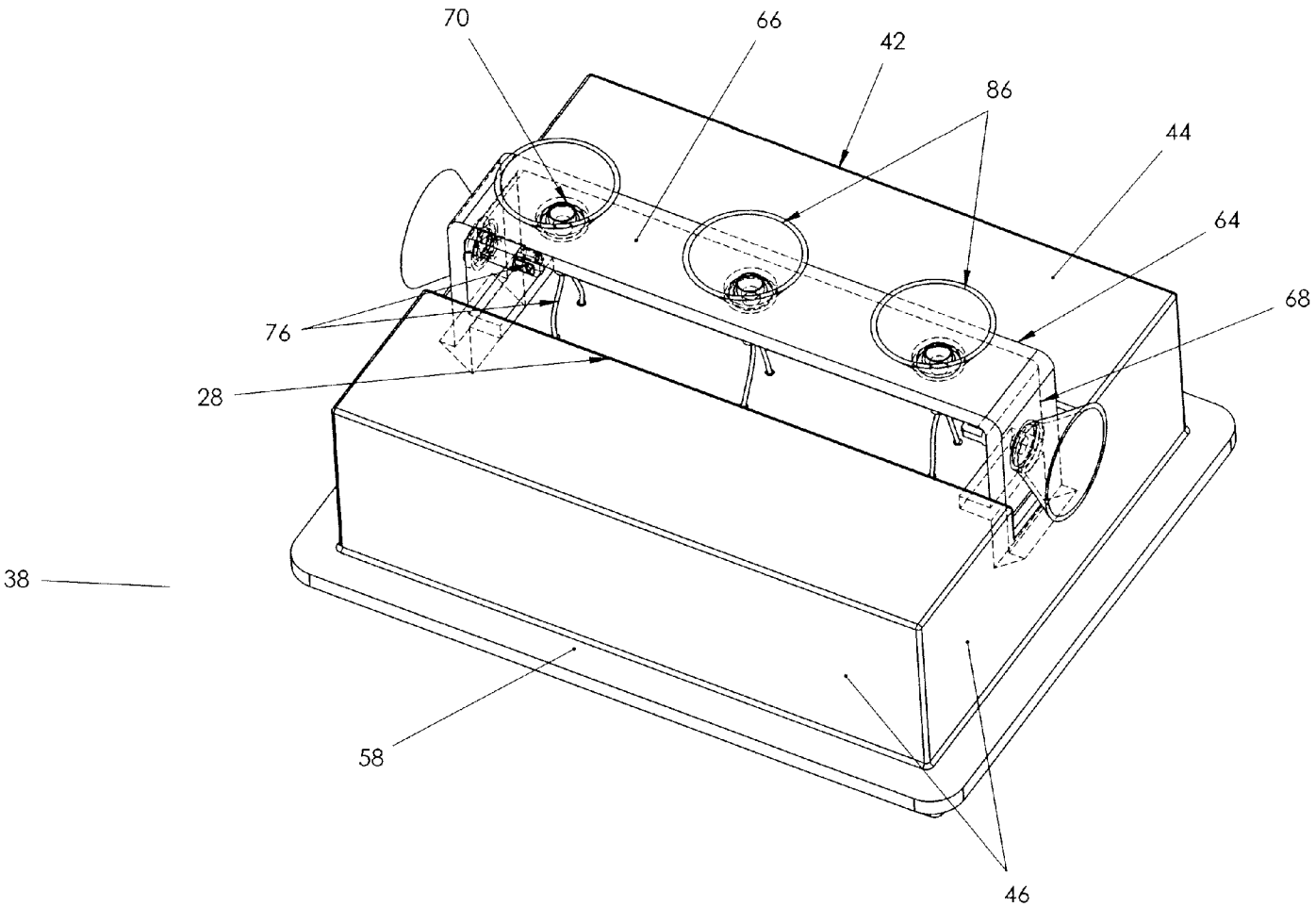
FIG. 3 is a perspective view of the lighting module of the present invention.
Figure 4:
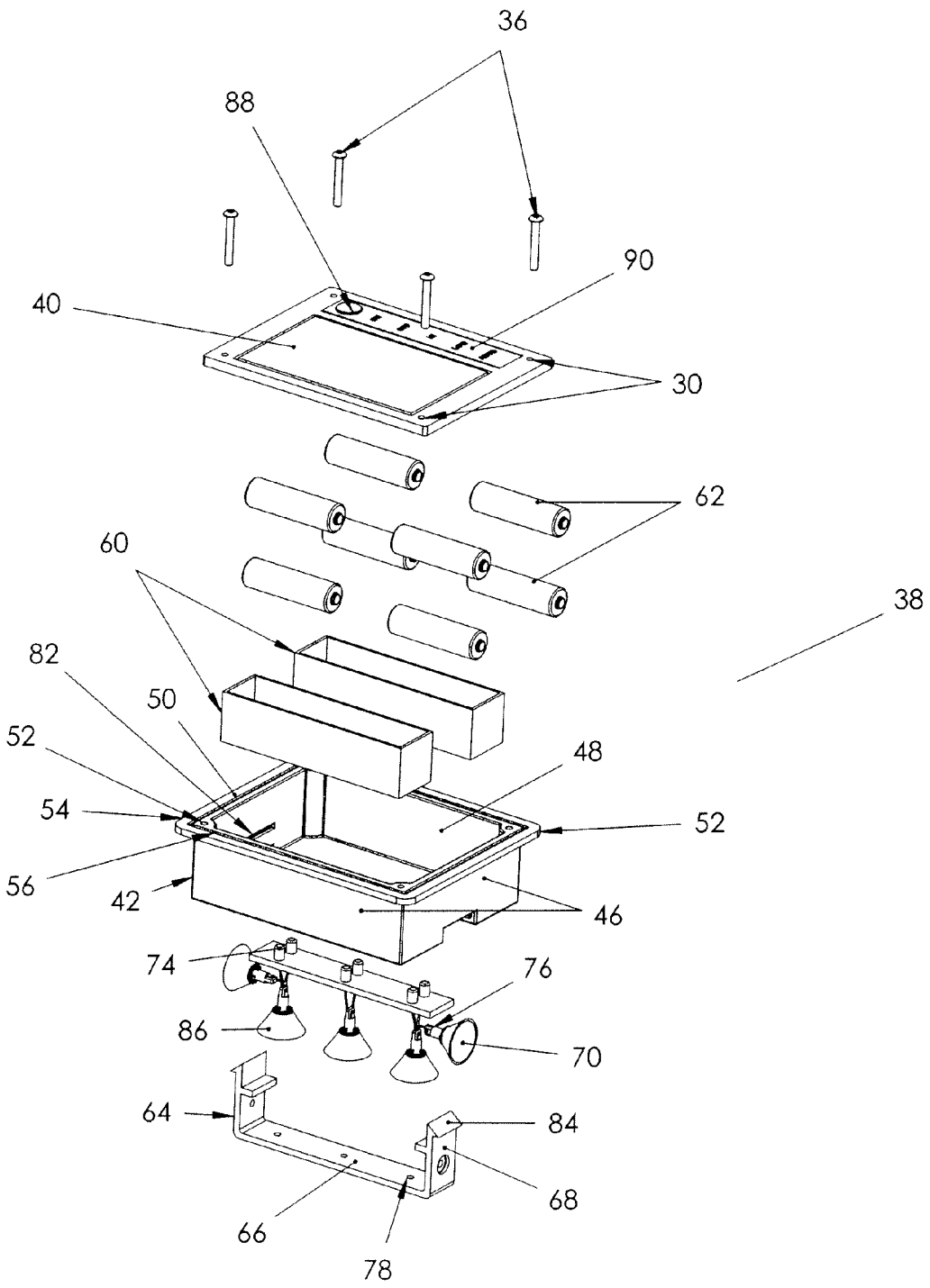
FIG. 4 is a fragmented view of the lighting module of the present invention.
Figure 5:
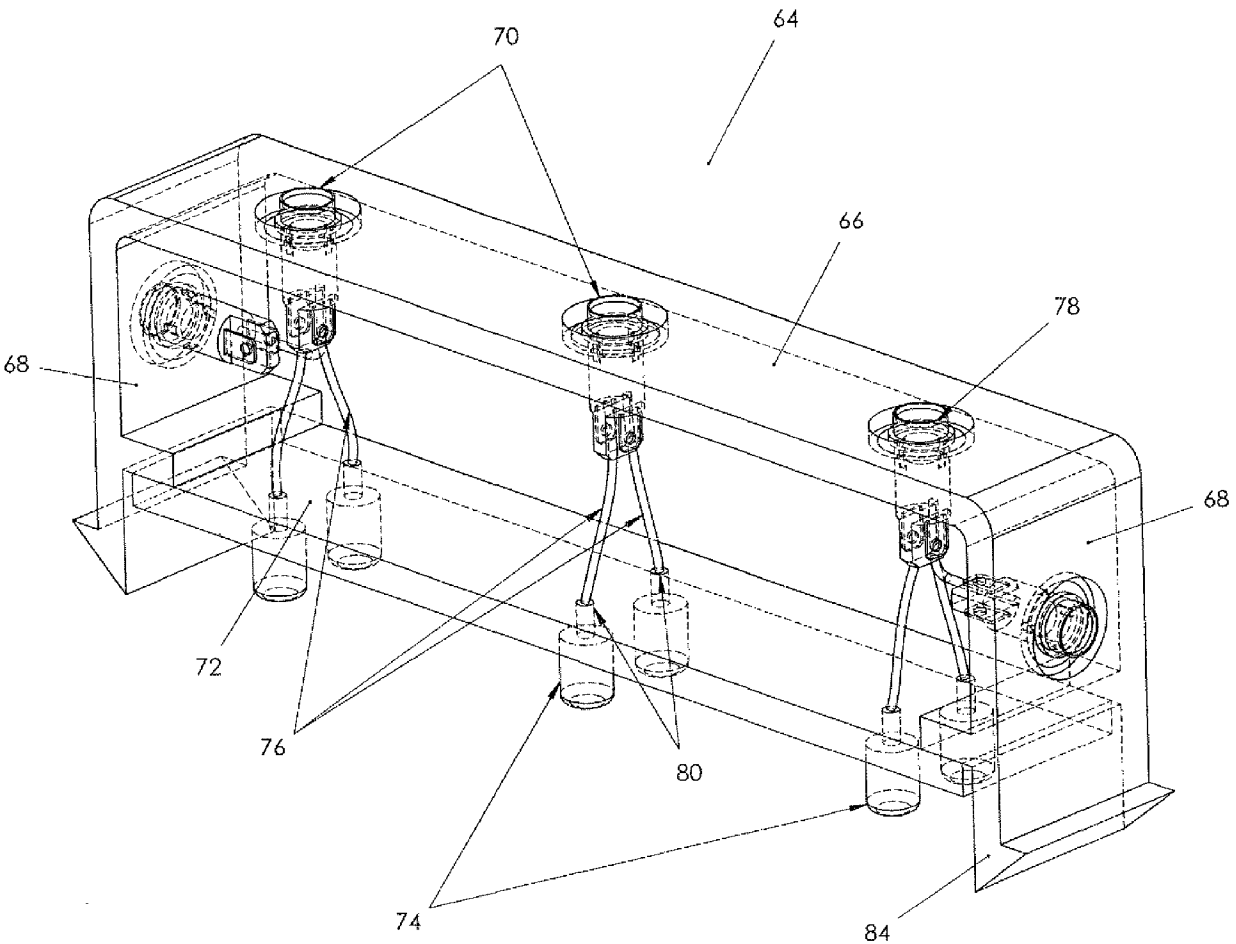
FIG. 5 is a perspective view of the U-shaped bracket of the present invention.

Referring to the Figures, wherein like numerals indicate corresponding parts throughout the several views, a marker 20 for floating on the surface of a body of water is generally shown. The marker 20 includes a housing 22 having a cylindrical shape with an outer surface 24 extending along an axis A between opposite ends 26 and presenting an open interior chamber (not shown). The housing 22 is preferably of a translucent material for allowing light to pass through the housing 22. The material could have any color, but is preferably a color that is easily visible in water during the day. To enhance the visibility of the marker 20, a fluorescent material can be added to the plastic or fluorescent paint or coating can be used to cover the marker 20 or any other suitable material can be used to coat or paint the marker 20 to make the marker 20 highly visible. In the enabling embodiment, each of the opposite ends 26 of the marker 20 are frusto-conical with integral caps to render the chamber (not shown) closed.

In the enabling embodiment, the marker 20 has a pair of flanges 28 axially spaced from one another and extending radially outward from the outer surface 24 of the housing 22. Each of the flanges 28 presents a pair of apertures 30, in which a first clip 32 extends through one of the apertures 30 on one of the flanges 28 and a second clip 32 extends through one of the apertures 30 on the other of the flanges 28 for receiving a line to attach the housing 22 to the line. The openings 34 of the clips 32 are larger than the diameter of the line, allowing the marker 20 to move along the line, ensuring that the marker 20 will float at and extend above the water line. It should be appreciated that more or fewer clips 32 and flanges 28 could be used. It should also be appreciated that the line could include ropes, chains etc.

In a further embodiment, the marker 20 has a longitudinally extending bore that is larger than the diameter of the line in which the line extends through, allowing the marker 20 to move along the line. In this embodiment, the marker 20 has a slot formed in the body of the marker 20 that intersects the longitudinal bore. The slot has a width that is equal to or slightly less that the diameter of the line so that the marker 20 can be forced over the line and the line received from the longitudinal bore. Because the width of the slot is equal to or less than the diameter of the line, the marker 20 cannot slip off the line. It should be appreciated that the marker 20 could be made with a bore diameter that is equal to or less than the diameter of the line so that it does not move along the length of the line. In this embodiment, the marker 20 would not move, but is fixed to the line which would allow the marker 20 to reside above the waterline between the waterline and the boat.

In a further embodiment, the marker 20 is made in two halves that can be clamped together around the line. In this embodiment, the two halves have fasteners that clamp the marker 20 together around the anchor line. The fasteners could be screws, nuts and bolts, formed mating fasteners integrally formed on the halves etc.

In a further embodiment, the marker 20 could be made as a single unit with a longitudinally extending bore through which the line may be threaded.

In the enabling embodiment, the housing 22 presents a mounting opening 34 in the outer surface 24. A lighting module 38 is disposed in the mounting opening 34 and extends into the interior chamber (not shown) of the translucent housing 22 for illuminating the translucent housing 22. The lighting module 38 includes a solar collector 40 disposed in the mounting opening 34 in the outer surface 24 of the housing 22 for receiving ambient light and for converting the ambient light to electricity. The lighting module 38 includes a box 42 disposed in the interior chamber (not shown) that has a bottom 44, sides 46 and an open top 48. The solar collector 40 is arranged such that it closes the open top 48 of the box 42. It should be appreciated that the solar collector 40 could be positioned at other locations on the outer surface 24 of the housing 22 and an alternate closing device could be used to close the top of the box 42. An o-ring 50 is disposed between the solar module and the box 42 for sealing the box 42 to the solar collector 40 and for preventing fluid from entering the box 42. A threaded bore 52 is disposed on each of the four corners 54 of the upper surface 56 of the box 42. An aperture 30 is disposed on each of the four corners of the solar collector 40 to correspond with the threaded bores 52 of the box 42. A screw 36 extends through each of the apertures 30 in the solar collector 40 and threadedly engages the corresponding threaded bore 52 of the box 42 to secure the solar collector 40 to the box 42.

In addition, there is a seal (not shown) for sealing the lighting module 38 to the housing 22 in the mounting opening 34, e.g., an adhesive, an o-ring, or the line. It should be appreciated that alternate sealing methods could be used for sealing the lighting module 38 to the housing 22, for example the housing 22 could be sandwiched between the outer flange 58 of the box 42 and the solar collector 40.

A pair of trays 60 are disposed in the box 42 with the trays 60 abutting opposite sides 46 of the box 42 for containing a plurality of batteries 62. The bottom 44 of the box 42 presents an opening 45 having a rectangular shape between the trays 60 in the box 42. The lighting module 38 includes a bracket 64 having a U-shape presenting a base 66 and a pair of legs 68 extending perpendicularly away from the base 66 through the opening 45 of the bottom 44 of the box 42. The lighting module 38 includes a plurality of light emitters 70 being spaced from one another and supported by the legs 68 and base 66 of the bracket 64 for emitting light. The light emitters 70 of the enabling embodiment are Light Emitting Diodes (LEDs 70), however it should be appreciated that other types of light emitters 70 could be used including incandescent bulbs, fluorescent bulbs etc. A plate 72 extends between the legs 68 of the bracket 64 and includes a plurality of electrical contacts 74 spaced from one another and electrically connected to the LEDs 70 by means of wires 76. The bracket 64 includes a plurality of bracket bores 78 through which the wires 76 are threaded. The plate 72 includes a plurality of plate bores 80 through which the wires 76 are threaded. The electrical contacts 74 of the plate 72 are electrically connected to the trays 60 for establishing electrical communication between the batteries 62 in the trays 60 and the LEDs 70. Electrical connectors (not shown) interconnect the contacts of the plate 72 to the trays 60.

At least two of the sides 46 of the box 42 present a notch 82 aligned with the rectangular opening 45. Each of the legs 68 of the bracket 64 define a hook 84 mating with the notches 82 of the box 42 to interconnect the bracket 64 and the box 42. In addition, the ends of each leg 68 are ramped, allowing the legs 68 of the bracket 64 to easily be snapped into the notches 82 of the box 42. A plurality of reflectors 86 having conical shapes are disposed around the LEDs 70 for focusing light emitted by the LEDs 70. The lighting module 38 includes a light sensor 88 disposed on the outer surface 24 of the housing 22 for sensing ambient light. Further, the lighting module 38 includes a controller 90 electrically connected to the light sensor 88 and the LEDs 70. The controller 90 has an on mode for powering the LEDs 70, an off mode for removing power from the LEDs 70 and an auto mode for powering the LEDs 70 only in response to the ambient light sensed by the light sensor 88 being less than a predetermined threshold.

In a further embodiment, a light source could be mounted within openings in the marker 20, allowing the marker 20 to be constructed of non-translucent materials such as rubber, metal, aluminum etc.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. The use of the word "said" in the apparatus claims refers to an antecedent that is a positive recitation meant to be included in the coverage of the claims whereas the word "the" precedes a word not meant to be included in the coverage of the claims. In addition, the reference numerals in the claims are merely for convenience and are not to be read in any way as limiting.

ELEMENT LIST

| Element Symbol | Element Name |
|---|---|
| A | axis |
| 20 | marker |
| 22 | housing |
| 24 | outer surface |
| 26 | ends |
| 28 | flanges |
| 30 | apertures |
| 32 | clip |
| 33 | clip opening |
| 34 | mounting opening |
| 36 | screw |
| 38 | lighting module |
| 40 | solar collector |
| 42 | box |
| 44 | bottom |
| 45 | rectangular opening |
| 46 | sides |
| 48 | open top |
| 50 | o-ring |
| 52 | threaded bore |
| 54 | corners |
| 56 | upper surface |
| 58 | outer flange |
| 60 | trays |
| 62 | battery |
| 64 | bracket |
| 66 | base |
| 68 | legs |
| 70 | LEDs |
| 72 | plate |
| 74 | electrical contacts |
| 76 | wires |
| 78 | bracket bores |
| 80 | plate bores |
| 82 | notch |

-continued

| Element Symbol | Element Name |
|---|---|
| 84 | hook |
| 86 | reflectors |
| 88 | light sensor |
| 90 | controller |

What is claimed is:

1. A buoyant marker for floating on the surface of a body of water comprising;

a housing having a cylindrical shape with an outer surface extending along an axis between opposite ends and presenting an open interior chamber, said housing being of a translucent material for allowing light to pass through said housing, each of said opposite ends being frusto-conical with integral caps to render said chamber closed, a pair of flanges axially spaced from one another and extending radially outward from said outer surface of said housing, each of said flanges presenting a pair of apertures, a first clip extending through one of said apertures on one of said flanges and a second clip extending through one of said apertures on the other of said flanges for receiving a line to attach said housing to the line, said housing presenting a mounting opening in said outer surface, a lighting module disposed in said interior chamber of said translucent housing for illuminating said translucent housing, said lighting module including a solar collector disposed in said mounting opening in said outer surface of said housing for receiving ambient light and for converting the ambient light to electricity, said lighting module including a box disposed in said interior chamber and having a bottom and sides and an open top, said solar collector closing said open top of said box, an o-ring disposed between said solar collector and said box for sealing said box to said solar collector and for preventing fluid from entering said box, a seal sealing said lighting module to said housing in said mounting opening, a pair of trays disposed in said box with said trays abutting opposite sides of said box for containing a plurality of batteries, said bottom of said box presenting an opening having a rectangular shape between said trays in said box, said lighting module including a bracket having a U-shape presenting a base and a pair of legs extending perpendicularly away from said base through said opening of said bottom of said box, said lighting module including a plurality of light emitters being spaced from one another and supported by said legs and base of said bracket for emitting light, said light emitters being LEDs, a plate extending between said legs of said bracket and including a plurality of electrical contacts spaced from one another and electrically connected to said LEDs, said electrical contacts of said plate being electrically connected to said trays for establishing electrical communication between the batteries in said trays and said LEDs, at least two of said sides of said box presenting a notch aligned with said rectangular opening, each of said legs of said bracket defining a hook mating with said notches of said box to interconnect said bracket and said box, a plurality of reflectors having conical shapes disposed around said LEDs for focusing light emitted by said LEDs, said lighting module including a light sensor disposed on said outer surface of said housing for sensing ambient light, and said lighting module including a controller electrically connected to said light sensor and said LEDs and having an on mode for powering said LEDs and having an off mode for removing power from said LEDs and having an auto mode for powering said LEDs only in response to the ambient light sensed by said light sensor being less than a predetermined threshold.

* * * * *

UNITED STATES PATENT AND TRADEMARK OFFICE

CERTIFICATE OF CORRECTION

PATENT NO. : 8,439,716 B2
APPLICATION NO. : 12/945374
DATED : May 14, 2013
INVENTOR(S) : Paul Mandrik It is certified that error appears in the above-identified patent and that said Letters Patent is hereby corrected as shown below:

In the Specification

Column 2, Line 40: “34” should read -- 33 --.

Signed and Sealed this
Tenth Day of December, 2013

Margaret A. Focarino

Margaret A. Focarino
*Commissioner for Patents of the United States Patent and Trademark Office*